United States Patent [19]

Cicin-Sain et al.

[11] 4,440,089

[45] Apr. 3, 1984

[54] RAILWAY TRACK BALLAST TAMPING DEVICE

[75] Inventors: Yvo Cicin-Sain, Bussigny; Yvan Deliyski, Lausanne, both of Switzerland

[73] Assignee: Canron Inc., Crissier, Switzerland

[21] Appl. No.: 311,246

[22] Filed: Oct. 14, 1981

[30] Foreign Application Priority Data

Oct. 29, 1980 [CH] Switzerland ..... 8037/80

[51] Int. Cl.[3] ..... E01B 27/16

[52] U.S. Cl. ..... 104/12

[58] Field of Search ..... 104/7 R, 7 B, 10, 12

[56] References Cited

U.S. PATENT DOCUMENTS

| | | | |
|---|---|---|---|
| 3,625,156 | 12/1971 | Anderson | 104/12 |
| 3,799,059 | 3/1974 | Sieke et al. | 104/12 |
| 4,218,978 | 8/1980 | Pasquini | 104/10 X |

*Primary Examiner*—Randolph Reese

*Attorney, Agent, or Firm*—Robert E. Burns; Emmanuel J. Lobato; Bruce L. Adams

[57] ABSTRACT

In a railway track ballast tamping device, a tamping unit is carried for vertical adjustment by a support mounted on the frame structure of a vehicle and comprises at least one pair of jointly-operating tamping tools crossing each other. The arm of these tools are adapted to pivot on opposite eccentric cranks formed on an eccentric shaft rotatably mounted in a bearing rigidly fastened to the support; the upper ends of the arms, opposite the pick-forming thereof, are each pivotally connected to a hydraulic cylinder inclined not in excess of 30° to the vertical; the planes passing through the axis of rotation on the eccentric shaft and the center of the opposite eccentric cranks thereof form between them an angle of 40° to 80° in order to warrant a symmetrical, synchronous oscillatory motion of the packers carried by the lower ends of the picks. To prevent the transmission of detrimental vibration to the support during the rotation of the eccentric shaft, there are provided, in addition to out-of-balance weight carried by a flywheel rigid with the eccentric shaft, balance weights fastened to the hydraulic cylinders and disposed above the level of the pivotal connections between these cylinders and the support. Furthermore, the tamping tools of a pair disposed on the same side of a tie have their upper ends rigidly interconnected.

4 Claims, 3 Drawing Figures

RAILWAY TRACK BALLAST TAMPING DEVICE

BACKGROUND OF THE INVENTION

This invention relates to a railway track ballast tamping device of the type comprising a frame structure adapted to travel on the track rails and at least one tamping unit carried by a support adjustably mounted for vertical movement on said frame structure, said tamping unit consisting of at least one pair of opposite co-operating tamping tools having each one arm and at least one tamping pick secured thereto, an eccentric driven shaft rotatably mounted in said support and rigid with at least one flywheel provided with an out-of-balance weight, and at least one pair of eccentric cranks on which the arms of one pair of tamping tools are pivoted for transmitting a swinging motion to the tamping picks, said arms being coupled to said support through extensible members on the one hand located at a predetermined distance above the upper ends of said arms pivotally coupled to said support and on the other hand pivotally connected to each arm, whereby these arms can rotate about their pivot point on said eccentric shaft.

A tamping device of this character is already known (Austrian Pat. No. 352 169), in which the arms of the tamping tools have a substantially right-angular bent configuration, like a knee lever, and the ends of these arms which are opposite the tamping packers are pivoted on the eccentric cranks of a common eccentric shaft. The extensible coupling members consist of double-acting hydraulic cylinders disposed substantially vertically and pivotally connected at one end to the elbow area of each arm of the tamping tool and at the other end to the tamping-tool support. During the rotation of the eccentric shaft the crank-engaging arm ends accomplish a circular movement and, in contrast thereto, the arm elbows connected to the hydraulic cylinders accomplish an oscillatory reciprocating motion along a circular arc of which the center is at the opposite end of the corresponding hydraulic cylinder which is pivotally connected to the tamping tool support and therefore has a relatively long radius. This motion results from the fact that the elbow of an arm cannot vibrate in a vertical direction since the hydraulic cylinder is held against vertical movement. Thus, a substantially horizontal swinging motion is impressed to the tamping packers or blades, which is particularly advantageous for producing the desired ballast tamping action. Moreover, the construction of this known tamping device, in which the tamping tool is pivoted directly to an eccentric or crank shaft revolving in bearings rigidly fitted in the support, is much simpler and sturdier than other known tamping machines of complicated construction and geometry.

Notwithstanding its relatively simple and sturdy construction, this known tamping device does not meet all the requirements consistent with an optimal exploitation. Thus, a horizontal swinging motion of the tamping packers, in fact of the tampers proper, when the packers have already penetrated into the ballast, yet not necessarily during the initial penetration of the packers into the ballast, is preferable. Furthermore, the mass centers of both bent arms are relatively spaced from each other on either side of the vertical plane of symmetry passing through the axis of the eccentric shaft, whereby the movable masses are so distributed as to substantially eliminate the dynamic forces and torques exerted on the support as a consequence of the eccentric shaft rotation, an awkward arrangement at least when the tamping device is constructed and utilized as a single-tie or double-tie one. An essential requirement laid upon the tamping machine lies in the fact that the support of the tamper tool and therefore also the frame structure of the complete machine or vehicle must not, as far as possible, oscillate as a consequence of vibrating or rotating masses, since this would seriously jeopardize the stability of the machine and the quality of the tampering operation.

Another problem arises with the type of tamping device briefly described hereinabove because care must be taken that the two packers of a same pair of tools oscillate constantly symmetrically, i.e. synchronously with each other. Should these swinging movements become asymmetrical, not only the quality of the ballast tamping work would be seriously impaired but also undesired horizontal vibrations would develop in the complete device.

SUMMARY OF THE INVENTION

It is the primary object of the present invention to provide a railway track ballast tamping device of the kind set forth hereinabove while preserving a simple, sturdy construction and adhering to a design so conceived that the dynamic forces and torques exerted on the support are at least approximately cancelled or eliminated, without any additional constructional cost, while improving the quality of the tamping operation.

This problem is solved by providing a track ballast tamping device of the kind disclosed hereinabove, characterized in that the arms of a pair of tamping tools consist each of a two-armed, substantially rectilinear lever and cross each other in the region of the eccentric shaft, that the fulcra between the two arms and the coupling members are located on the side of the eccentric shaft which is opposite the tamping tools, and that the dynamic forces and torques exerted during the rotation of the eccentric shaft on the support are at least substantially compensated by balance weights fastened not only to the flywheel but also to said members, said weights constituting extensions of the connecting members above the level of the pivotal connection between said members and the support.

It was found quite surprisingly that it is only possible to prevent in an optimal way detrimental vibration from being transmitted to the support by properly distributing the movable masses, if the two arms of a pair of tamping tools are disposed crosswise and if, in addition to a proper selection of the degree of unbalance of the flywheel or flywheels, complementary balance weights are provided on the coupling members, as described hereinabove.

The balancing weights are so calculated and arranged that an equivalent and uniform rectilinear rod (taking due account of the mass and arrangement of each coupling member, of which it has the same specific weight per unit of length) projects by one-third of its total length beyond the support's pivot point.

Providing an unbalance weight on the flywheel alone is not sufficient for eliminating the support vibration, as already explained in the foregoing. By disposing the two arms of a pair crosswise it is also possible to locate the mass center of the tamping tool in the vicinity of the vertical plane of symmetry passing through the eccentric axis or preferably at least substantially in the vicinity of this plane.

In addition, the tamping device according to this invention is advantageous in that the paths of the swinging movements accomplished by the ballast-tamping packers carried by the ends of the tools having wide-angle obtuse bent arms, are inclined to the horizontal when the tools are driven on either side of a tie and penetrate into the ballast. It is only when the two packers approach each other as they are gradually driven through the ballast that they assume a horizontal path. Therefore, the paths of said swinging motion are advantageously inclined as the tamping packers penetrate into the mass of gravel, and it is only when the tamping operation proper take place within the ballast that at least a nearly horizontal position is attained.

As explained hereinafter, the swinging movements of the two tamping packers of a pair are symmetrical to each other when the angle between the two planes passing through the axes of rotation of the eccentric shaft and of the two eccentric cranks, for a given geometry or configuration of all the pivot centers or fulcra of the device, has a fully predetermined value which can be calculated. When preferably the members connecting the arms of a pair of tamping tools to the support extend at least substantially vertically or at any rate are inclined to a maximum angle of 30° to the vertical, said angle, warranting definitely symmetrical or synchronous oscillations of the two co-operating tampers, is within the range of 40° to 80°. The out-of-balance weight of the flywheel thus lies on the bisectrix of this angle on the side of the eccentric shaft opposite the two branches of said angle.

As a rule, a tamping unit comprises two pairs of tamping tools disposed on either side of a rail, for simultaneously compressing the ballast under a tie on both sides of a rail fastening. The stability and operation of such a tamping unit will be further enhanced according to the invention in that the mutually corresponding arms of the two pairs of tamping tools disposed on either side of a rail are interconnected by a rigid cross member secured to the ends of the arms concerned which are opposite the tamper, preferably in close vicinity of the pivotal mounting of the coupling member. These cross members act at the same time as balance weights to the tamper packers.

By properly distributing its movable component elements, the tamping devices according to the present invention can be balanced so favorably that the devices can be constructed and operated at will as single-tie, twin-tie or three-tie tamping machines without giving rise to problems in connection with the transmission of vibration to the supporting structure.

DESCRIPTION OF THE PREFERRED EMBODIMENT

Figure 1:
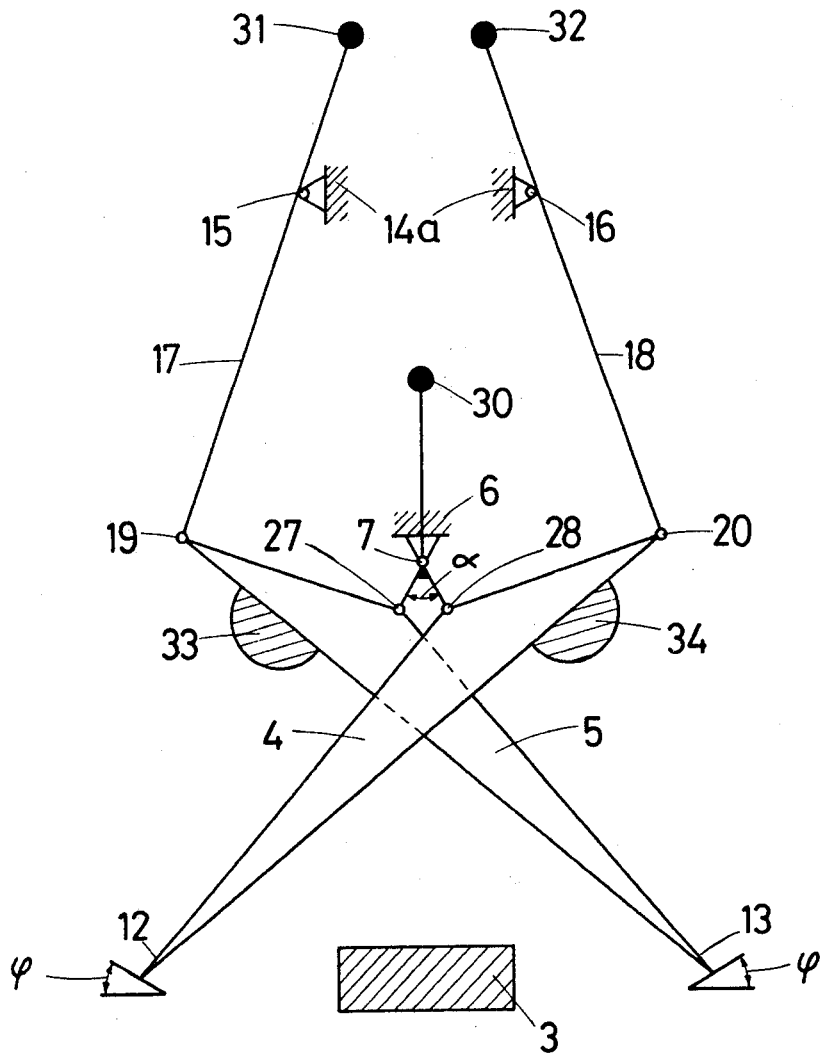
FIG. 1 is a diagram illustrating the geometrical layout of the device according to the invention.
Figure 3:
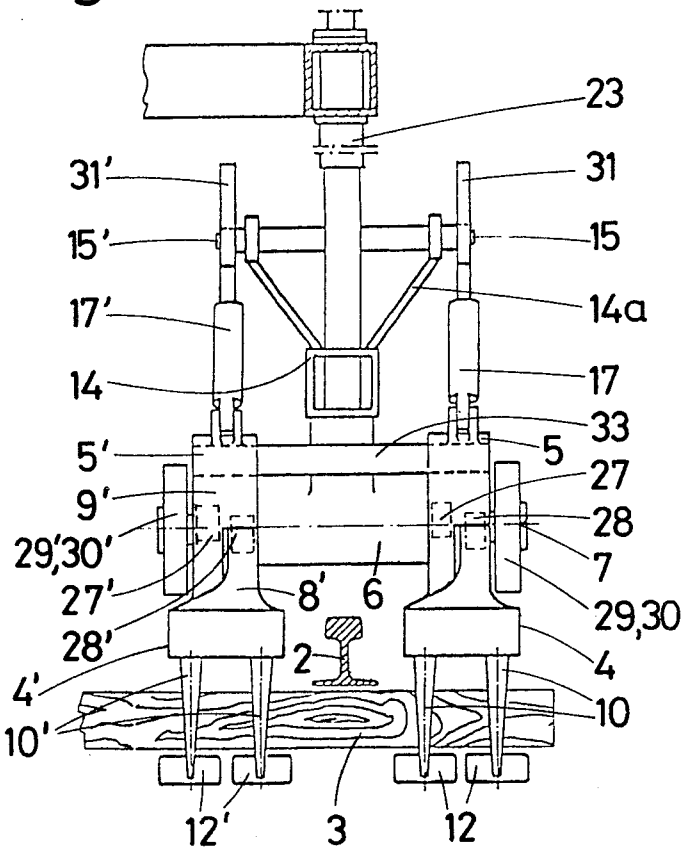
FIG. 3 is a front view of the tamping unit as seen in the direction of the arrow III of FIG. 2.
Figure 2:
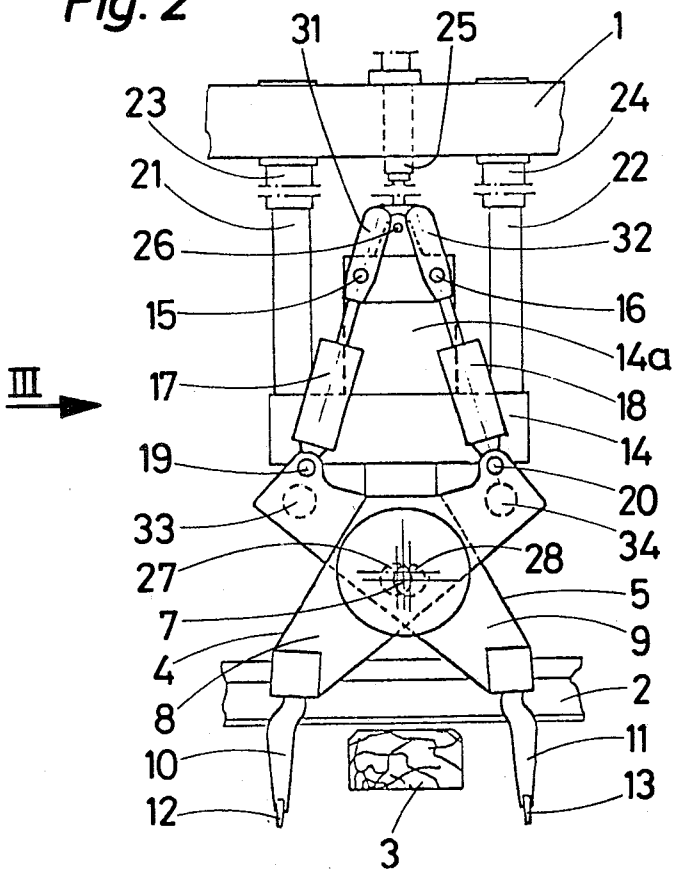
FIG. 2 is a side elevational view showing the essential component elements of a tamping unit comprising tamping tools disposed on either side of a track tie.

Referring first to the diagram of FIG. 1, illustrating the geometrical layout of a tamping unit comprising two jointly-operating tamping tools, the basic elements and pivot points, pivot centers or fulcra are designated by the same reference numerals as the corresponding component elements of the device in the exemplary form of embodiment shown in FIGS. 2 and 3. On an eccentric shaft or crank shaft 7 disposed at right angles to the plane of the drawing sheet of FIG. 1 and rotatably mounted in a bearing 6 rigidly secured to the supporting structure of the device, a pair of eccentric cranks trunnions are pivoted, their axes being designated by the reference numerals 27 and 28. The lines interconnecting the axis of eccentric shaft 7 and the center 27 or 28 of one or the other crank make a predetermined fixed angle.

Pivoted to the cranks 27 and 28 are two arms of a pair of tamping tools 4 and 5 crossing each other and constituting two-armed levers with respect to the eccentric shaft 7. The operative lower ends of these levers are provided with working packers or heads 12, 13 adapted to compress the ballast on either side of a rail tie 3. The upper ends of the levers are connected at pivot points 19 and 20 to the lower ends of corresponding coupling members 17 and 18, respectively, fulcrumed in turn to an extension 14*a* of the supporting structure of the device, namely at pivot points 15 and 16 disposed at a certain distance above the tamping tools 4 and 5. The coupling members 17, 18 consisting preferably of double-acting hydraulic cylinders or motors extend at least substantially vertically or are inclined by no more than 30° to the vertical and carry on an extension, on either side, i.e. above the pivot points 15 and 16, a pair of balance weights 31 and 32. When the arrangement and mass of a coupling member 17 or 18 including its weights 31 or 32 are to be replaced by equivalent straight rods of same mass having substantially the same specific weight per unit of length, the pivot points 15 or 16 will divide the length of this rod by a 2:1 ratio; in other words, the rod extends beyond the pivot points 15 or 16 by a distance corresponding to half the distance existing between the pivot points 19 and 15 or 20 and 16. A further balance weight is obtained by providing an inertia weight 30 on a flywheel 29 mounted on the eccentric shaft 7, this weight 30 being shifted along the bisectrix of angle $\alpha$ on the side of the axis of eccentric shaft 7 which is opposite the angle sides.

The upper lever ends of tamping tools 4 and 5 are furthermore each rigidly connected by a cross member 33 or 34 extending at right angles to the plane of the drawing in FIG. 1 with a second pair of likewise interconnected tamping tools disposed on the same side of the tie 3 but on the opposite side of the rail fastening. These cross members act as counterpoises to the tamping packers 12 and 13, respectively.

During the rotation of the eccentric shaft 7 with its two eccentric cranks or trunnions 27 and 28, the tamping tools 4 and 5 and consequently the underlying tamping packers 12 and 13 are caused to swing, so that the plane of oscillation corresponds to the plane of the drawing in FIG. 1, and by reducing the length of said members 17 and 18 the packers 12 and 13 are moved toward each other as a consequence of the corresponding swinging motion imparted to their arms. In the amply divaricated position of tamping tools 4 and 5, as shown in FIG. 1, in which they are driven into the ballast, the paths of the swinging movements of packers 12 and 13 are inclined by an angle $\phi$ to the horizontal, and this is advantageous in that this oblique direction of the swinging movements facilitates the penetration of the packers into the ballast. To the extent that the packers 12 and 13 are subsequently driven into the ballast for compressing the stones, and thus caused to move toward each other, the value of this inclination angle will decrease until, in the last stage of the compacting operation, the swinging movements of packers 12 and 13 become substantially horizontal, thus promoting the quality of the ballast compacting operation.

When planning a tamping device according to the invention, the procedure consists in firstly determining for the complete geometrical arrangement all the pivot points or rotational centers 7, 15, 16, 19, 20, 27 and 28 according to the angle $\alpha$ between the radii or planes passing through the axis of eccentric shaft 7 and the centers of both cranks 27 and 28, in order to impart to the two tamping packers 12 and 13 a fully synchronous or symmetrical swinging motion with respect to the vertical plane of symmetry passing through the axis of the eccentric shaft 7. It will be seen that this essential requirement is generally met only with a single predetermined angle providing a symmetrical swinging motion, which is important as far as the quality of the tamping action is concerned, for a given configuration of the above-mentioned pivot points and rotational centers in general. This angle changes when the geometry of the pivot points and rotational centers are modified, but in the case illustrated, in which the angle of inclination of the coupling members 17 and 18 does not exceed 30° to the vertical, it lies between about 40° and about 80°, and corresponds in actual practice for example to 53°.

For the angle $\alpha$ so calculated the distribution of all the movable masses will then be such that the dynamic forces and torques exerted on the support of the device as a consequence of the rotation of the eccentric shaft 7, notably vibrations, will at least be nearly eliminated. This result is made possible with the assistance of the additional inertia weights 30, 31 and 32 provided for balancing the complete device, and it is facilitated by the possibility of shifting the centers of gravity of the balance weights carried by the tamping tools 4 and 5 extending along an essentially straight line, with their cross members 33 and 34 at least substantially in the vertical plane of symmetry passing through the axis of eccentric shaft 7, or in close vicinity thereof. The above-mentioned necessary calculations can be made according to known methods and preferably with the assistance of a computer. Actually, the tamping devices according to the present invention can be constructed at will as a single-tie, double-tie or three-tie tamping machine, that is, for tamping the ballast under only one tie at a time, or simultaneously under two or three adjacent ties, without any risk of experiencing difficulties in connection with vibration in the supporting structure.

FIGS. 2 and 3 of the drawings illustrate a tamping assembly mounted for vertical adjustment on a frame structure adapted to travel on rails 2. This assembly comprises on either side of a rail 2 a pair of simultaneously operating tamping tools 4, 5 or 4', 5' all of which, as will be explained more in detail presently, are pivoted on a common eccentric shaft 7 rotatably mounted in a bearing 6. The tamping tools 4 and 5 pertaining to one pair, shown in FIG. 2 and partly concealed in FIG. 3, on the right-hand side of rail 2, comprise an arm 8 or 9 and two tamping picks 10 or 11 secured each to one arm and having each a packer 12 or 13 rigidly fastened to the lower end of the corresponding pick and adapted, in the operative position of the device, to operate on one or the other side of a tie 3. The tools belonging to the other pair 4' and 5' are concealed in FIG. 2 and visible in FIG. 3, though also partly concealed in the latter on the left-hand side of rail 2; they comprise the arms 8' and 9' which, like arms 8 and 9, carry each two picks with packers, of which in FIG. 3 only the tamping pick 10' fastened to arm 8' with its packers 12' are visible on one side of the tie.

All movable parts of the tamping assembly are pivotally mounted or journaled on a support 14 common to the two pairs of tamping tools 4, 5 and 4', 5', and adjustably suspended through the intermediary of a vertical hydraulic cylinder 25 from the frame structure 1. This support 14 is guided during its reciprocating movements by a pair of vertical columns 21 and 22 rigidly connected thereto and slidably engaged in a pair of guide bearings 23 and 24 fitted in said frame structure 1. The piston-rod of the hydraulic cylinder 25 anchored at its upper end to said frame structure 1 is pivotally connected to a trunnion 26 engaging the upper end of a vertical extension 14*a* of support 14. The arrangement is such that the tamping tool can be raised above the level of rail 2 with the assistance of hydraulic cylinder 25.

Rigidly secured to the bottom face of support 14 and disposed across the rail 2 is the bearing 6 for the eccentric shaft 7 formed at each projecting end with a pair of adjacent cranks 27, 28 or 27', 28', each crankshaft end having a flywheel 29 or 29' keyed thereon. Each flywheel 29, 29' is provided with a properly calculated out-of-balance weight 30, 30'. Pivotally mounted on the adjacent eccentric cranks of a pair are the arms 8 and 9 or 8' and 9' of the opposite tamping tools. These arms cross each other in their fulcrum area, that is, in the region of the eccentric shaft 7, and therefore constitute two-armed levers with respect to said shaft 7. The planes extending through the axis of the eccentric shaft and through the center of one or the other of the opposite eccentric cranks provide the angle $\alpha$ mentioned hereinabove with reference to FIG. 1, and the out-of-balance weight 30 or 30' of flywheel 29 or 29' is located along the bisectrix of this angle, as already explained also with reference to FIG. 1.

Though the following description refers only to the pair of tamping tools 4 and 5, it is of course also applicable to the other pair of tamping tools 4' and 5'. The upper ends of arms 8 and 9 opposite the packers 12 and 13 are pivotally connected at 19 or 20 to the lower ends of two double-acting hydraulic cylinders 17 and 18 constituting the extensible coupling members pivotally connected on the other hand to the extension 14*a* of support 14 at a certain distance above the upper fulcra 15 and 16. On each side of said fulcra 15 and 16, extensions of hydraulic cylinders 17, 18 carry balance weights 31, 32, respectively, of which the size and weight can be calculated from the diagram of FIG. 1.

When the hydraulic cylinders 17 and 18 are operated, the arms 8 and 9 are caused to pivot about the eccentric shaft 7, whereby the picks 10 and 11 together with their packers 12 and 13 are moved toward and away from the tie 3. During the rotation of eccentric shaft 7 the arms 8 and 9 perform at their fulcra and therefore intermediate their ends pivoted to eccentric cranks 27 and 28, a circular motion corresponding to the crank throw and which, due to the pivotal coupling of the upper ends of the arms to the hydraulic cylinders 17 and 18, and also to a proper choice of the value of angle $\alpha$, causes the packers 12 and 13 to vibrate symmetrically or synchronously with respect to the tie 3.

Both tamping tools 4' and 5' at the other end of eccentric shaft 7 have their arms 8' and 9' connected to support 14 in the same fashion through hydraulic cylinders of which FIG. 3 show only the hydraulic cylinder 17' pivotally connected to pivot point 15' of extension 14*a* and provided with its balance-weight 31'. The tamping tools 4 and 4' or 5 and 5' disposed on the same side of tie 3 are rigidly interconnected by a cross member 33 or 34; these cross members 33, 34 are connected directly by means of pins 19 and 20 to the ends of arms 8, 8' or 9, 9' opposite tamping picks 10 and 11, so that they not only improve the stability of the device but act with their packers 12, 13 as a means for balancing the weight of the packers.

Of course, a similar tamping unit, like the one described hereinabove with reference to FIGS. 2 and 3, is also suspended above the other track rail from frame structure 1, so that in the known way a tie 3 can be tamped simultaneously under both rail fastenings. All the movable or vibrating parts are so balanced that detrimental vibrations and more particularly vibrations likely to jeopartize the stability of the support 14 and consequently of the frame structure 1 and the part supported thereby are safely avoided.

What is claimed is:

1. A railway track ballast tamping device comprising a frame structure movable on the track rails and at least one tamping unit disposed on a support mounted on said frame structure, said tamping unit comprising in turn at least one pair of opposite and jointly operating tamping tools each consisting of an arm and of at least one pick fastened thereto, a driven eccentric shaft rotatably mounted on said support and provided with at least one flywheel having an out-of-balance weight affixed thereto and at least one pair of cranks coupled to the arms of said one pair of tamping tools in order to transmit a vibratory motion thereto, said arms being connected to said support by means of coupling members pivotally connected on the one hand to pivot means carried by said support and located above the upper ends of said arms, and on the other hand to the corresponding arm, said coupling members being so oriented as to cause said arms to oscillate about their pivot region on said eccentric shaft, wherein:

said arms of said one pair of tamping tools have each substantially the configuration of a substantially rectilinear two-armed lever and cross each other in the region of said eccentric shaft, the pivot centers between the arms and the coupling members lie on the eccentric shaft side opposite the picks, and for balancing at least partially the dynamic forces and torques exerted on said support during the rotation of said eccentric shaft, in addition to said out-of-balance weight affixed to said flywheel other balance weights are secured to said coupling members at locations overlying the pivotal connections between said coupling members and said support.

2. The railway track ballast tamping device of claim 1, wherein said coupling members comprise double-acting hydraulic cylinders disposed substantially vertically or inclined at an angle not in excess of 30 degrees to the vertical, the plane passing through the axis of rotation of said eccentric shaft and the axis of rotation of one or the other of the cranks of said pair forms an angle of 40° to 80°, and for a predetermined configuration of all the pivot centers the oscillations accomplished by packers carried by said one pair of tamping tools are symmetrical to each other.

3. The railway track ballast tamping device of claim 2, wherein two pairs of said tamping tools are disposed respectively on opposite sides of a rail and wherein the arms of said two pairs of tamping tools are interconnected by a cross member secured to the areas of said arms which are opposite said picks and in close vicinity of the pivotal connection between said arms and said coupling member.

4. The railway track ballast tamping device of claim 3, wherein the balance weight secured to each coupling member is so dimensioned and disposed, with respect to the mass and arrangement of said coupling members and their balance weights, that an equivalent straight rod of same configuration, having the same specific weight per unit of length, would project by one-third of its total length above the pivotal connection between the coupling member concerned and said support.

* * * * *